US009075345B2

(12) United States Patent
Mitsuhashi

(10) Patent No.: US 9,075,345 B2
(45) Date of Patent: Jul. 7, 2015

(54) TONER CARTRIDGE CAPABLE OF PREVENTING OCCURRENCE OF TONER DISCHARGE FAILURE AND IMAGE FORMING APPARATUS WITH THE SAME

(71) Applicant: SHARP KABUSHIKI KAISHA, Osaka-shi, Osaka (JP)

(72) Inventor: Kunihiro Mitsuhashi, Osaka (JP)

(73) Assignee: SHARP KABUSHIKI KAISHA, Osaka-Shi, Osaka (JP)

( * ) Notice: Subject to any disclaimer, the term of this patent is extended or adjusted under 35 U.S.C. 154(b) by 0 days.

(21) Appl. No.: 14/252,994

(22) Filed: Apr. 15, 2014

(65) Prior Publication Data

US 2014/0334850 A1 Nov. 13, 2014

(30) Foreign Application Priority Data

May 8, 2013 (JP) ..... 2013-098785

(51) Int. Cl.
*G03G 15/08* (2006.01)

(52) U.S. Cl.
CPC ..... *G03G 15/0889* (2013.01)

(58) Field of Classification Search
CPC ..... G03G 15/0889
USPC ..... 399/263
See application file for complete search history.

(56) References Cited

U.S. PATENT DOCUMENTS

| | | | | |
|---|---|---|---|---|
| 5,913,097 | A | 6/1999 | Nakano et al. | |
| 7,792,438 | B2 * | 9/2010 | Sato | 399/12 |
| 8,548,362 | B2 * | 10/2013 | Okuda | 399/263 |
| 8,862,032 | B2 * | 10/2014 | Hayashi | 399/263 |
| 2009/0060589 | A1 | 3/2009 | Tanaka | |
| 2009/0220285 | A1 | 9/2009 | Kimura et al. | |

FOREIGN PATENT DOCUMENTS

| | | |
|---|---|---|
| JP | 10-240008 | 9/1998 |
| JP | 2009-210737 | 9/2009 |
| JP | 2012-108566 A | 6/2012 |
| JP | 2013-68703 A | 4/2013 |

* cited by examiner

*Primary Examiner* — William J Royer
(74) *Attorney, Agent, or Firm* — Nixon & Vanderhye P.C.

(57) ABSTRACT

Provided is a toner cartridge capable of preventing occurrence of toner discharge failure when a toner discharge section is below a toner storage section. A toner cartridge includes a toner storage container having a toner storage section and a toner discharge section, a toner stirring member provided in the toner storage section, and a toner discharge member provided in the toner discharge section. The toner stirring member includes a rotating shaft member rotatably supported by the toner storage section, a first blade portion having a first base end portion fixed to the rotating shaft member and a first free end portion coming into contact with an inner surface of the toner storage section, and a second blade portion having a second base end portion fixed to the rotating shaft member and a second free end portion not coming into contact with the inner surface of the toner storage section.

8 Claims, 6 Drawing Sheets

TONER CARTRIDGE CAPABLE OF PREVENTING OCCURRENCE OF TONER DISCHARGE FAILURE AND IMAGE FORMING APPARATUS WITH THE SAME

CROSS-REFERENCE TO RELATED APPLICATION

This application claims priority to Japanese Patent Application No. 2013-098785, which was filed on May 8, 2013, the contents of which are incorporated herein by reference in its entirety.

BACKGROUND OF THE TECHNOLOGY

1. Field of the Technology

The present technology relates to a toner cartridge which is used in an image forming apparatus using an electrophotographic system, and to an image forming apparatus.

2. Description of the Related Art

An image forming apparatus which is mounted in a printer, a copy machine, or the like forms an image using a toner which is stored in a developing device in the image forming apparatus. In the field of an image forming apparatus, a toner cartridge which supplies a toner to a developing device has been hitherto known. When the toner in the developing device is consumed, the toner cartridge supplies a toner in the toner cartridge into the developing device.

For example, Japanese Unexamined Patent Publication JP-A 2009-210737 discloses a toner cartridge including a toner storage container which has a toner storage section (toner stirring section) configured to store a toner to be replenished into a developing device and a toner discharge section provided adjacent to the toner storage section with a toner discharge port formed therein, a toner stirring member disposed in the toner storage section, the toner stirring member including toner stirring plates configured to stir toner stored in the toner storage section and a pair of stirring blades (toner scooping blades) configured to be flexible and to scoop a toner in the toner storage section to convey a toner to the toner discharge section, and a toner discharge member provided in the toner discharge section the toner discharge member conveying a toner conveyed to the toner discharge section by the toner stirring member toward the toner discharge port.

In the toner cartridge disclosed in JP-A 2009-210737, a pair of stirring blades are provided at an interval of 180 degrees in a circumferential direction of a rotating shaft so as to extend outward in a radial direction at the tip portions of the respective plate-shaped toner stirring plates protruding from the rotating shaft outward in the radial direction of the rotating shaft, and the respective stirring blades are designed such that their lengths in the radial direction of the rotating shaft are a length enough to come into contact with the inner surface of the toner storage section. Thereby, since a toner stuck to the inner surface of the toner storage section can be scraped off by the pair of stirring blades along with the rotation of the rotating shaft, it is possible to reduce a toner remaining on the inner wall of the toner storage section as much as possible without conveying a toner to the toner discharge section.

The toner cartridge disclosed in JP-A 2009-210737 has a configuration in which a toner storage space in the toner storage section and a toner storage space in the toner discharge section are partitioned by a partition wall provided vertically upright and arranged in a horizontal direction. In this toner cartridge, the toner stored in the toner storage section and the toner stored in the toner discharge section are present separately without affecting each other. Accordingly, even if the toner stirring member provided in the toner stirring section rotates around the axial line, the rotation operation of the toner stirring member has no influence on the toner stored in the toner discharge section or the rotation operation of the toner discharge member provided in the toner discharge section.

In this way, contrary to the toner cartridge in which the toner storage space in the toner storage section and the toner storage space in the toner discharge section are provided adjacent to each other in the horizontal direction, in a toner cartridge in which the toner discharge section is provided adjacent to and vertically below the toner storage section, and the respective toner storage spaces vertically communicate with each other, if the toner stirring member disclosed in JP-A 2009-210737 is provided in the toner storage section, when the amount of the toner stored in the toner cartridge is large, the toner stirring member is rotated around the axial line, each stirring blade revolves inside the toner storage section in a curved state so as to extend toward an upstream side in the rotational direction of the toner stirring member outward in the radial direction of the rotating shaft, whereby a force for compressing a toner is applied to the toner stored in the toner discharge section.

Thereby, the toner stored in the toner discharge section is in a consolidation state by application of the weight of the toner stored in the toner storage section, and there is concern that the toner discharge member is locked and not rotatable. The consolidation state causes a decrease in fluidity of toner, and there is concern that toner conveyed to the toner discharge port is not discharged smoothly from the toner discharge port.

SUMMARY OF THE TECHNOLOGY

An object of the technology is to provide a toner cartridge and an image forming apparatus capable of preventing the occurrence of toner discharge failure even if a toner discharge section including a toner discharge port is disposed vertically below a toner storage section.

The technology provides a toner cartridge mountable in an electrophotographic image forming apparatus with a developing device. The toner cartridge includes a toner storage container having a toner storage section which stores a toner therein, a toner discharge section provided vertically below the toner storage section in a mounted state in the image forming apparatus, the toner discharge section having a toner discharge port for discharging a toner, and a communicating hole forming section which forms a communicating hole for guiding the toner in the toner storage section to the toner discharge section; a toner stirring member which is rotatably supported by the toner storage section and stirs the toner stored in the toner storage section, and a toner discharge member which is rotatably supported by the toner discharge section and conveys the toner guided from the toner storage section to the toner discharge section through the communicating hole toward the toner discharge port, the toner stirring member including a rotating shaft member which is supported by the toner storage section so as to be rotatable around an axial line thereof, a flexible sheet-like first stirring blade of which one end portion in a predetermined first direction perpendicular to a thickness direction thereof is fixed to the rotating shaft member along the axial line, the flexible sheet-like first stirring blade having a length so that the other end portion in the predetermined first direction comes into contact with an inner surface of the toner storage section in the predetermined first direction, and a flexible sheet-like second stirring blade of which one end portion in a predetermined second direction perpendicular to a thickness direction thereof is fixed to the rotating shaft member along the axial line, the flexible sheet-like second stirring blade having a length so that the other end portion in the predetermined second direction does not come into contact with the inner surface of the toner storage section in the predetermined second direction.

It is preferable that the toner cartridge further comprises a driving force transmission member connected to the rotating shaft member, the driving force transmission member transmitting a driving force for rotating the rotating shaft member in a rotational direction which is one circumferential direction around the axial line, to the rotating shaft member, and the flexible sheet-like second stirring blade is configured so that the one end portion is distant from the axial line in a radial direction perpendicular to the axial line, and the other end portion is located on a downstream side in the rotational direction from the one end portion.

It is preferable that the flexible sheet-like first stirring blade is configured so that the one end portion is distant from the axial line in the radial direction perpendicular to the axial line, and the other end portion is located on an upstream side in the rotational direction from the one end portion.

It is preferable that a distance between the axial line and the other end portion of the flexible sheet-like first stirring blade is larger than a distance between the axial line and the inner surface of the toner storage section.

It is preferable that a distance between the axial line and the other end portion of the flexible sheet-like second stirring blade is smaller than the distance between the axial line and the inner surface of the toner storage section.

It is preferable that the flexible sheet-like first stirring blade and the flexible sheet-like second stirring blade are composed of a single sheet member.

It is preferable that the flexible sheet-like first stirring blade and the flexible sheet-like second stirring blade are composed of separate sheet members.

The technology provides an electrophotographic image forming apparatus with a developing device, comprising the toner cartridge which supplies a toner to the developing device.

Even if the toner discharge section including the toner discharge port is disposed vertically below the toner storage section, it is possible to smoothly discharge a toner from the toner discharge port and to prevent the occurrence of toner discharge failure.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
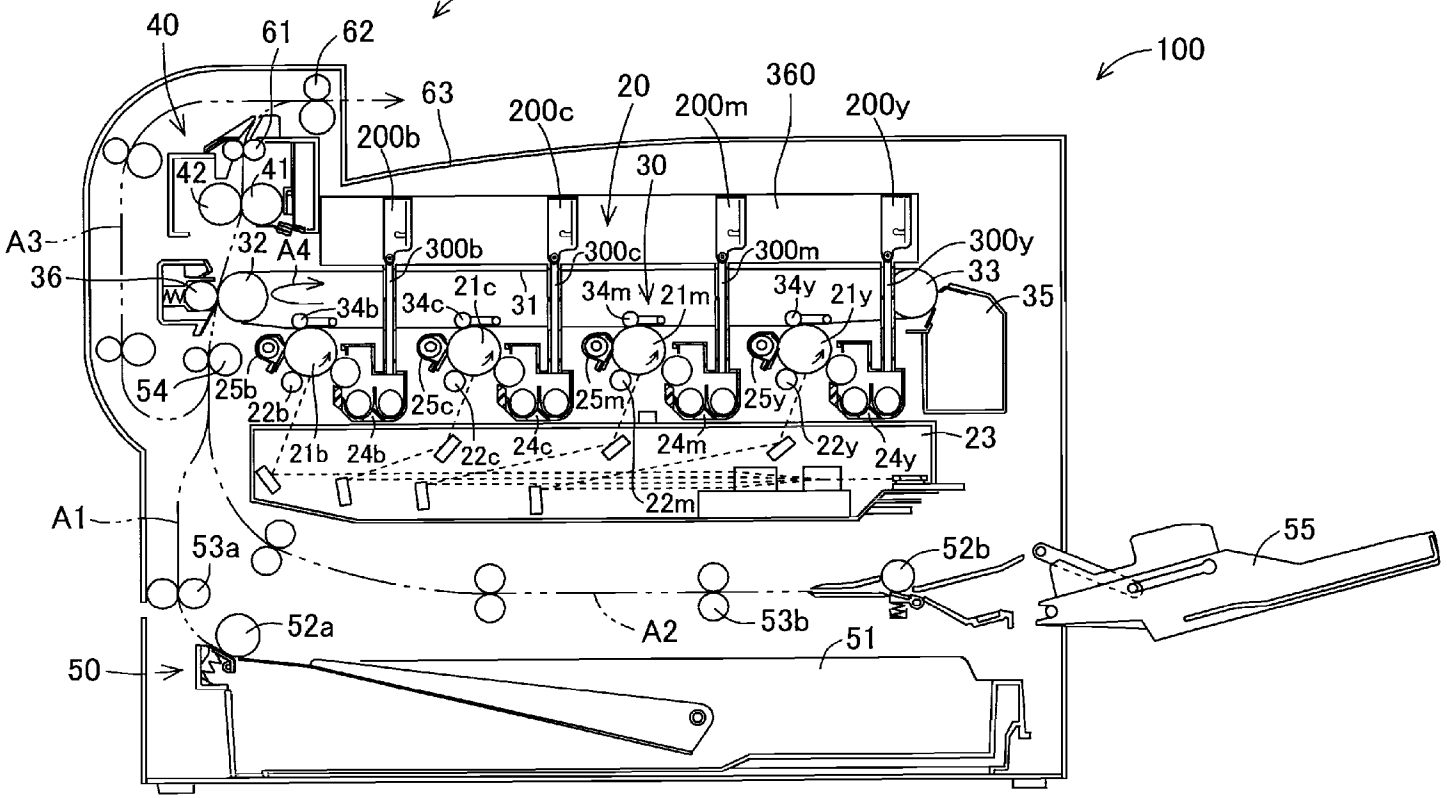
FIG. 1 is a schematic view showing the configuration of an image forming apparatus.

Now referring to the drawings, preferred embodiments are described below.

First, an image forming apparatus 100 including a toner cartridge 200 according to an embodiment will be described. FIG. 1 is a schematic view showing the configuration of the image forming apparatus 100. The image forming apparatus 100 is a multi-function machine which has a copy function, a printer function, and a facsimile function, and forms a full-color or monochrome image on a recording medium in accordance with image information to be transmitted. The image forming apparatus 100 has three print modes of a copier mode (copy mode), a printer mode, and a facsimile mode, and a print mode is selected by a control unit section (not shown) with the reception of an operation input from an operating section (not shown) or a print job from a personal computer, a mobile terminal device, an information recording medium, an external apparatus using a memory device, or the like.

The image forming apparatus 100 includes a toner image forming section 20, a transfer section 30, a fixing section 40, a recording medium feeding section 50, a discharge section 60, and a control unit section (not shown). The toner image forming section 20 includes photoreceptor drums 21*b*, 21*c*, 21*m*, and 21*y*, charging sections 22*b*, 22*c*, 22*m*, and 22*y*, an exposure unit 23, developing devices 24*b*, 24*c*, 24*m*, and 24*y*, cleaning units 25*b*, 25*c*, 25*m*, and 25*y*, toner cartridges 200*b*, 200*c*, 200*m*, and 200*y*, and toner supply pipes 300*b*, 300*c*, 300*m*, and 300*y*.

The toner cartridges 200*b*, 200*c*, 200*m*, and 200*y* are provided as a toner cartridge unit 360. The toner cartridge unit 360 will be described below. The transfer section 30 includes an intermediate transfer belt 31, a driving roller 32, a driven roller 33, intermediate transfer rollers 34*b*, 34*c*, 34*m*, and 34*y*, a transfer belt cleaning unit 35, and a transfer roller 36.

The photoreceptor drum 21, the charging section 22, the developing device 24, the cleaning unit 25, the toner cartridge 200, the toner supply pipe 300, and the intermediate transfer roller 34 are disposed for each color to correspond to image information of each color of black (b), cyan (c), magenta (m), and yellow (y) included in color image information. In this specification, in a case where four members corresponding to the colors, respectively, are discriminated, a letter representing each of colors b, c, m and y is attached to the end of a numeral representing each member and this is used as a reference numeral, and in a case where each of the members are collectively referred to, only the numeral representing each of the members is used as a reference numeral.

The photoreceptor drum 21 is supported by a driving unit (not shown) so as to be rotatable around an axial line thereof, and includes a conductive substrate (not shown), and a photoconductive layer formed on a surface of the conductive substrate. The conductive substrate may have various shapes, and for example, a cylindrical shape, a column shape, a thin film sheet shape, or the like may be exemplified. The photoconductive layer is formed of a material showing a conductive property when irradiated with light. As the photoreceptor drum 21, it is possible to use a member including a cylindrical member (conductive substrate) formed of aluminum and a thin film (photoconductive layer) that is formed on an outer circumferential surface of the cylindrical member and is made of, for example, amorphous silicon (a-Si), selenium (Se), or organic photo-semiconductor (OPC).

The charging section 22, the developing device 24, and the cleaning unit 25 are disposed in this order along the rotational direction of the photoreceptor drum 21, and the charging section 22 is disposed on a vertically lower side in relation to the developing device 24 and the cleaning unit 25.

The charging section 22 is a device that charges the surface of the photoreceptor drum 21 at predetermined polarity and potential. The charging section 22 is disposed at a position facing the photoreceptor drum 21 along the longitudinal direction of the photoreceptor drum 21. In the case of a contact charging type, the charging section 22 is disposed to come into contact with the surface of the photoreceptor drum 21. In the case of a non-contact charging type, the charging section 22 is disposed to be spaced from the surface of the photoreceptor drum 21.

The charging section 22 is disposed at the periphery of the photoreceptor drum 21 together with the developing device 24 and the cleaning unit 25. It is preferable that the charging section 22 is disposed at a position close to the photoreceptor drum 21 in relation to the developing device 24 and the cleaning unit 25. In this manner, it is possible to reliably prevent occurrence of charging failure of the photoreceptor drum 21.

The photoconductor section 22 is disposed at the periphery of the photoreceptor drum 21 together with the developing device 24 and the cleaning unit 25. It is preferable that the photoconductor section 22 is disposed at a position close to the photoreceptor drum 21 in relation to the developing device 24 and the cleaning unit 25. In this manner, it is possible to reliably prevent occurrence of charging failure of the photoreceptor drum 21.

As the charging section 22, a brush type charging device, a roller type charging device, a corona discharge device, an ion generating device, or the like may be used. The brush type charging device and the roller type charging device are charging devices of contact charging type. In the brush type charging device, a charging brush, a magnetic brush, or the like is usable. The corona discharge device and the ion generating device are charging devices of non-contact charging type. In the corona discharge device, a wire-like discharge electrode, a saw-like discharge electrode, a needle-like discharge electrode, or the like is usable.

The exposure unit 23 is disposed so that light emitted from the exposure unit 23 passes between the charging section 22 and the developing device 24 and the surface of the photoreceptor drum 21 is irradiated with the light. The exposure unit 23 irradiates the surface of each of the photoreceptor drums 21*b*, 21*c*, 21*m*, and 21*y* that are in a charged state with laser light corresponding to image information of each color, respectively, and thereby an electrostatic latent image corresponding to the image information of each color is formed on the surface of each of the photoreceptor drums 21*b*, 21*c*, 21*m*, and 21*y*. As the exposure unit 23, a laser scanning unit (LSU) provided with a laser irradiation section and a plurality of reflective mirrors may be used. As the exposure unit 23, an LED (light emitting diode) array, a unit of suitably combining a liquid crystal shutter and a light source, or the like may be used.

The toner cartridge 200 is disposed vertically above the developing device 24 and stores an unused toner. The toner supply pipe 300 as a tubular member is connected to a vertically lower part of the toner cartridge 200. The toner cartridge 200 supplies a toner to the developing device 24 through the toner supply pipe 300. The details of the toner cartridge 200 will be described below.

The developing device 24 is a device which develops an electrostatic latent image formed on the photoreceptor drum 21 by means of a toner and forms a toner image on the photoreceptor drum 21. The toner supply pipe 300 is connected to a vertically upper part of the developing device 24.

The developing device 24 includes a developing tank, a developing roller, a first conveying screw, a second conveying screw, and a toner concentration detection sensor. The developing tank stores a toner in the internal space. In the developing tank, the developing roller, the first conveying screw, and the second conveying screw are rotatably supported. The developing tank has an opening at a position facing the photoreceptor drum 21, and the developing roller is provided at a position opposite to the photoreceptor drum 21 with the opening interposed therebetween.

The developing roller is a member that supplies a toner to the electrostatic latent image on the surface of the photoreceptor drum 21 in a portion closest to the photoreceptor drum 21. Upon toner supply, a potential having a polarity opposite to the charged potential of toner is applied to the surface of the developing roller as a developing bias voltage (developing bias). Thereby, the toner on the surface of the developing roller is smoothly supplied to the electrostatic latent image. By changing the value of the developing bias, it is possible to control the amount of toner (the amount of toner to be attached) to be supplied to the electrostatic latent image.

The first conveying screw is a member that faces the developing roller and supplies a toner to the periphery of the developing roller. The second conveying screw is a member that faces the first conveying screw and supplies a toner to be newly supplied into the developing tank through the toner supply pipe 300 to the periphery of the first conveying screw.

The toner concentration detection sensor is provided on the bottom surface of the developing tank. The toner concentration detection sensor detects toner concentration in the developing tank. As the toner concentration detection sensor, a general toner concentration detection sensor may be used, and for example, a transmitted light detection sensor, a reflected light detection sensor, a permeability detection sensor, and the like may be used. Among them, the permeability detection sensor is preferable.

The toner concentration detection sensor is electrically connected to a toner concentration control section. When it is determined that the toner concentration value by the toner concentration detection sensor is smaller than a predetermined set value, the toner concentration control unit rotates a toner discharge member 220 to be described later in the toner cartridge 200, and performs control such that toner in the toner cartridge 200 is supplied into the developing tank.

The cleaning unit 25 is a member that removes the toner remaining on the surface of the photoreceptor drum 21 after transferring the toner image onto the intermediate transfer belt 31 from the photoreceptor drum 21 and thereby cleans the surface of the photoreceptor drum 21. As the cleaning unit 25, for example, a plate-like member that scrapes the toner, and a container-like member that recovers the scraped toner are used.

According to the toner image forming section 20, the surface of the photoreceptor drum 21, that is in a uniformly charged state by the charging section 22, is irradiated with laser light corresponding to image information from the exposure unit 23, and thereby an electrostatic latent image is formed thereon. The toner is supplied to the electrostatic latent image on the photoreceptor drum 21 from the developing device 24, and thereby a toner image is formed. The toner image is transferred onto the intermediate transfer belt 31 described later. After the toner image is transferred onto the intermediate transfer belt 31, the toner remaining on the surface of the photoreceptor drum 21 is removed by the cleaning unit 25.

The intermediate transfer belt 31 is an endless belt-like member disposed vertically above the photoreceptor drum 21. The intermediate transfer belt 31 is supported around the driving roller 32 and the driven roller 33 with tension and forms a loop-like pathway, and runs in a direction indicated by an arrow A4.

The driving roller 32 is disposed to be rotatable around an axial line thereof by a driving unit (not shown). The driving roller 32 allows the intermediate transfer belt 31 to run in the direction indicated with the arrow A4 by rotation thereof. The driven roller 33 is provided to be rotatable in accordance with rotation of the driving roller 32, and generates a constant tension to the intermediate transfer belt 31 so that the intermediate transfer belt 31 does not go slack.

The intermediate transfer roller 34 is provided to come into pressure-contact with the photoreceptor drum 21 with the intermediate transfer belt 31 interposed therebetween and to be rotatable around an axial line thereof by a driving unit (not shown). As the intermediate transfer roller 34, for example, a roller member including a conductive elastic member on a surface of a metal (for example, stainless steel) roller having a diameter of 8 to 10 mm may be used. The intermediate transfer roller 34 is connected to a power source (not shown) that applies a transfer bias voltage and has a function of transferring the toner image formed on the surface of the photoreceptor drum 21 to the intermediate transfer belt 31.

The transfer roller 36 is provided to come into pressure-contact with the driving roller 32 with the intermediate transfer belt 31 interposed therebetween, and to be rotatable around an axial line thereof by a driving unit (not shown). At a pressure-contact portion (transfer nip region) between the transfer roller 36 and the driving roller 32, the toner image borne on and conveyed by the intermediate transfer belt 31 is transferred onto a recording medium fed from the recording medium feeding section 50 described later.

The transfer belt cleaning unit 35 is provided to be opposite to the driven roller 33 in relation to the intermediate transfer belt 31, and to come into contact with a toner bearing surface of the intermediate transfer belt 31. The transfer belt cleaning unit 35 is provided to remove the toner on the surface of the intermediate transfer belt 31 and recovers the removed toner after the transfer of the toner image onto the recording medium. When the toner remains attached to the intermediate transfer belt 31 after the transferring of the toner image onto the recording medium, there is a problem that the remaining toner is attached to the transfer roller 36 when the intermediate transfer belt 31 runs. When the toner is attached to the transfer roller 36, the toner may contaminate the rear surface of the next recording medium onto which the transferring is to be performed.

According to the transfer section 30, when the intermediate transfer belt 31 runs while being brought into contact with the photoreceptor drum 21, a transfer bias with a polarity opposite to the charging polarity of the toner on the surface of the photoreceptor drum 21 is applied to the intermediate transfer roller 34, and the toner image formed on the surface of the photoreceptor drum 21 is transferred onto the intermediate transfer belt 31. The toner images of the respective colors formed by the photoreceptor drum 21*y*, the photoreceptor drum 21*m*, the photoreceptor drum 21*c*, and the photoreceptor drum 21*b* are sequentially overlaid and transferred onto the intermediate transfer belt 31 in this order and thereby a full color toner image is formed. The toner image transferred onto the intermediate transfer belt 31 is conveyed to the transfer nip region by running of the intermediate transfer belt 31 and is transferred onto a recording medium at the transfer nip region. The recording medium having the toner image transferred thereto is conveyed to the fixing section 40 described later.

The recording medium feeding section 50 includes a paper feed box 51, pick-up rollers 52*a* and 52*b*, conveying rollers 53*a* and 53*b*, registration rollers 54, and a paper feed tray 55. The paper feed box 51 is a container-like member that is provided at a vertically lower part of the image forming apparatus 100 and stores recording mediums at the inside of the image forming apparatus 100. The paper feed tray 55 is a tray-like member that is provided in a side wall surface of the image forming apparatus 100 and stores recording mediums at the outside of the image forming apparatus 100. Examples of the recording medium include regular paper, a sheet for color copying, a sheet for an overhead projector, and a postcard.

The pick-up roller 52*a* is a member that takes out the recording mediums stored in the paper feed box 51 one by one and feeds the recording mediums to a paper conveyance path A1. The conveying rollers 53*a* are a pair of roller-like members, which are provided to come into pressure-contact with each other, and convey the recording medium in the paper conveyance path A1 toward the registration rollers 54. The pick-up roller 52*b* is a member that takes out the recording mediums stored in the paper feed tray 55 one by one and feeds the recording mediums to a paper conveyance path A2. The conveying rollers 53*b* are a pair of roller-like members, which are provided to come into pressure-contact with each other, and convey the recording medium in the paper conveyance path A2 toward the registration rollers 54.

The registration rollers 54 are a pair of roller-like members, which are provided to come into pressure-contact with each other, and feeds the recording medium fed from the conveying rollers 53*a* or 53*b* to the transfer nip region in synchronization with conveyance of the toner image borne on the intermediate transfer belt 31 to the transfer nip region.

According to the recording medium feeding section 50, in synchronization with conveyance of the toner image borne on the intermediate transfer belt 31 to the transfer nip region, the recording medium is fed to the transfer nip region from the paper feed box 51 or the paper feed tray 55 and then the toner image is transferred onto the recording medium.

The fixing section 40 includes a heating roller 41 and a pressure roller 42. The heating roller 41 is controlled to maintain a predetermined fixing temperature. The pressure roller 42 is a roller that comes into pressure-contact with the heating roller 41. The heating roller 41 nips the recording medium together with the pressure roller 42 while heating the recording medium, and melts toner constituting the toner image and fixes it onto the recording medium. The recording medium having the toner image fixed thereon is conveyed to the discharge section 60 described later.

The discharge section 60 includes conveying rollers 61, discharge rollers 62, and a catch tray 63. The conveying rollers 61 are a pair of roller-like members, which are provided to come into pressure-contact with each other on a vertically upper side of the fixing section 40. The conveying rollers 61 convey the recording medium having an image fixed thereon toward the discharge rollers 62.

The discharge rollers 62 are a pair of roller-like members, which are provided to come into pressure-contact with each other. In the case of one-sided printing, the discharge rollers 62 discharge the recording medium on which the one-sided printing is completed to the catch tray 63. In the case of double-sided printing, the discharge rollers 62 convey the recording medium on which the one-sided printing is completed to the registration rollers 54 through a paper conveyance path A3 and discharges the recording medium on which the double-sided printing is completed to the catch tray 63. The catch tray 63 is provided in the vertically top surface of the image forming apparatus 100 and stores the recording mediums having the image fixed thereon.

The image forming apparatus 100 includes the control unit section (not shown). The control unit section is provided in the vertically upper part of the internal space of the image forming apparatus 100 and includes a memory portion, a computing portion, and a control portion. To the memory portion, various setting values mediated through an operation panel (not shown) disposed on the vertically upper surface of the image forming apparatus 100, the results detected by sensors (not shown) disposed in various portions inside the image forming apparatus 100, image information from an external device and the like are inputted. Moreover, programs for executing various processes are written in the memory portion. Examples of the various processes include a recording medium determination process, an attachment amount control process, and a fixing condition control process.

As for the memory portion, memories customarily used in this technical field can be used, and examples thereof include a read-only memory (ROM), a random-access memory (RAM), and a hard disc drive (HDD). As for the external device, electrical and electronic devices which can form or obtain the image information and which can be electrically connected to the image forming apparatus 100 can be used. Examples thereof include computers, digital cameras, televisions, video recorders, DVD (Digital Versatile Disc) recorders, HDDVD (High-Definition Digital Versatile Disc) recorders, Blu-ray disc recorders, facsimile machines, and mobile terminal devices.

The computing portion takes out various kinds of data (for example, image formation commands, detection results, and image information) written in the memory portion and the programs for various processes and then makes various determinations. The control portion sends a control signal to the respective devices provided in the image forming apparatus 100 in accordance with the determination result by the computing portion, thus performing control on operations.

The control portion and the computing portion include a processing circuit which is realized by a microcomputer, a microprocessor, and the like having a central processing unit (CPU). The control unit section includes a main power source as well as the processing circuit. The power source supplies electricity to not only the control unit section but also to respective devices provided in the image forming apparatus 100.

Figure 2:
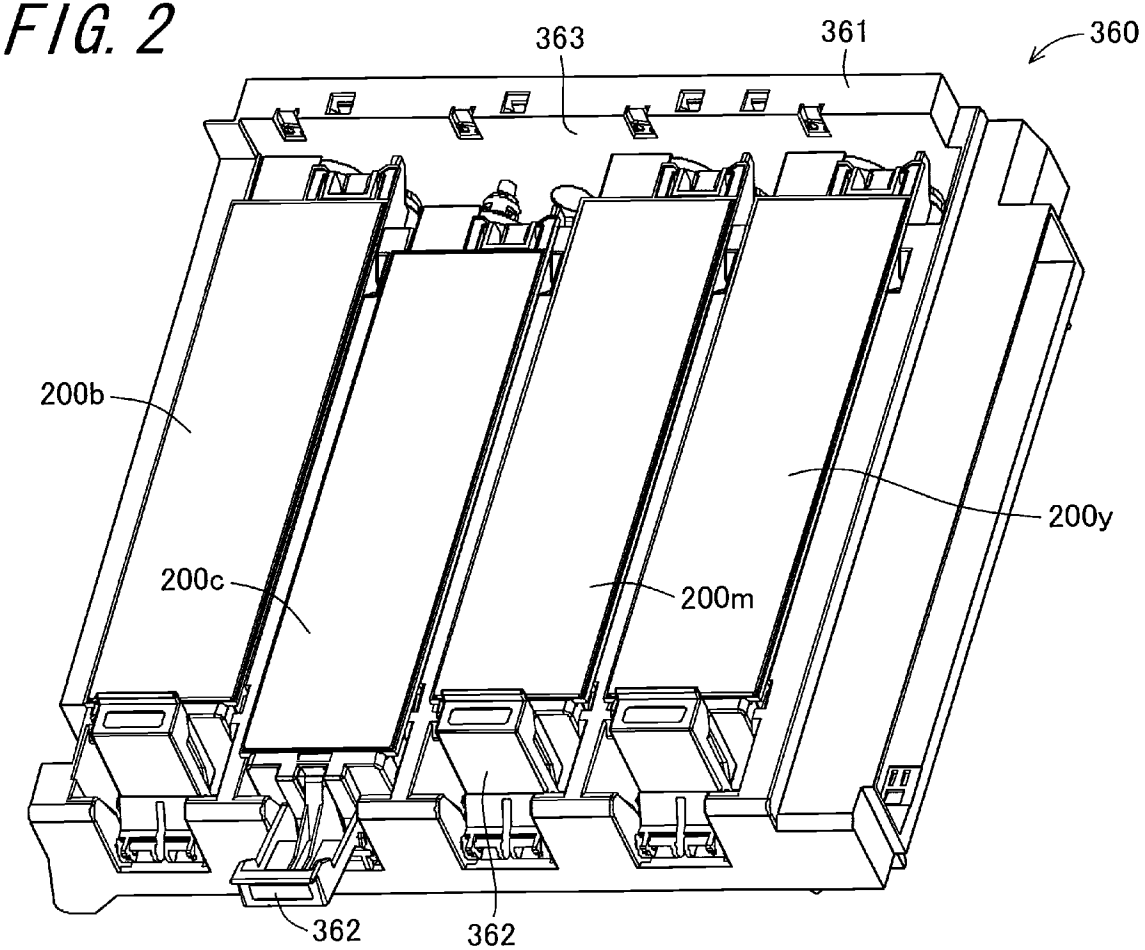
FIG. 2 is a perspective view showing a toner cartridge unit.

Next, the toner cartridge unit 360 will be described. FIG. 2 is a perspective view showing the toner cartridge unit 360. The toner cartridge unit 360 includes the toner cartridges 200*b*, 200*c*, 200*m*, and 200*y*, and a toner cartridge mounting base 361. The toner cartridge mounting base 361 includes a lock lever 362 which is configured to be angularly displaced, and a stopper plate 363. Each toner cartridge 200 is fixed to the toner cartridge mounting base 361 when the lock lever 362 is angularly displaced toward the stopper plate 363 in a state where the toner cartridge 200 is mounted on the toner cartridge mounting base 361.

Figure 3:
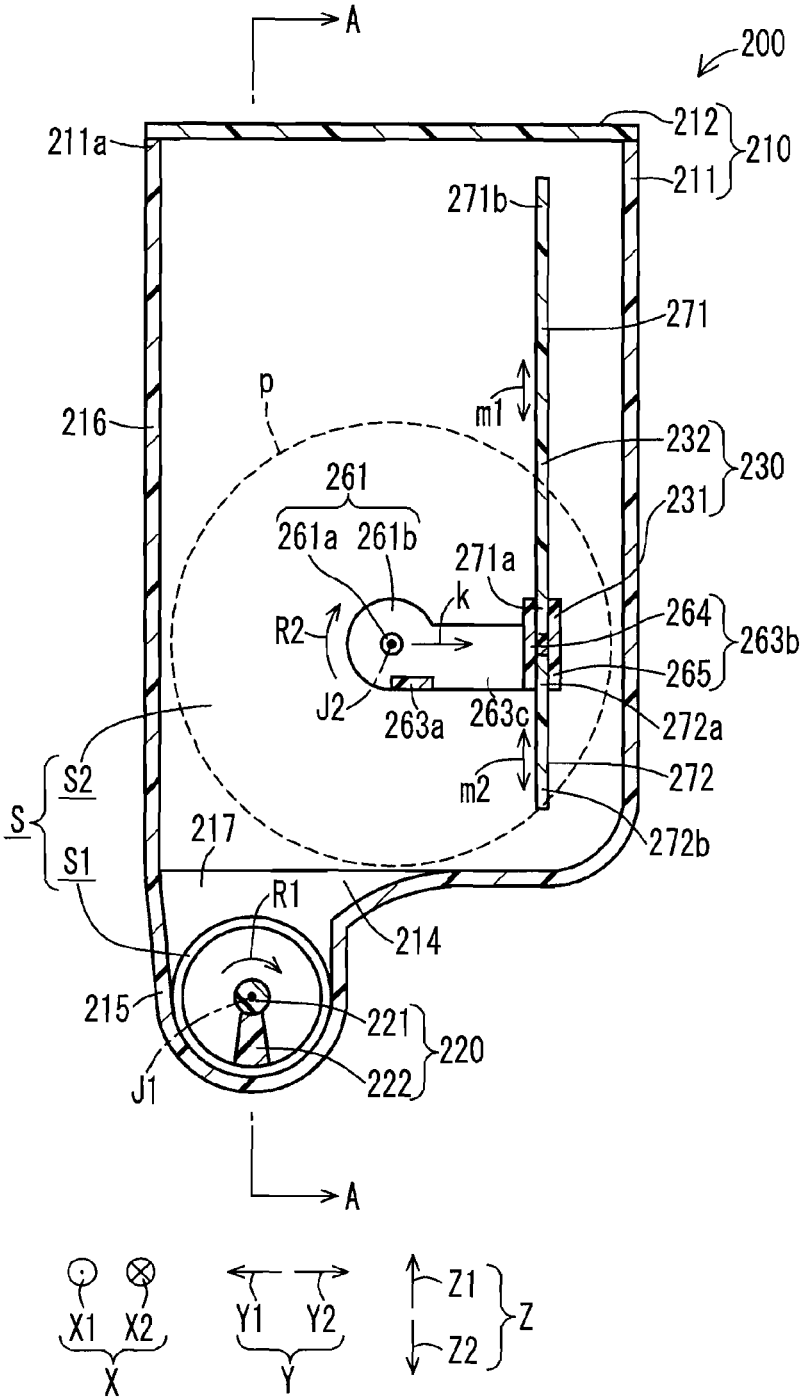
FIG. 3 is a sectional view of a toner cartridge taken along the line B-B in FIG. 4.
Figure 4:
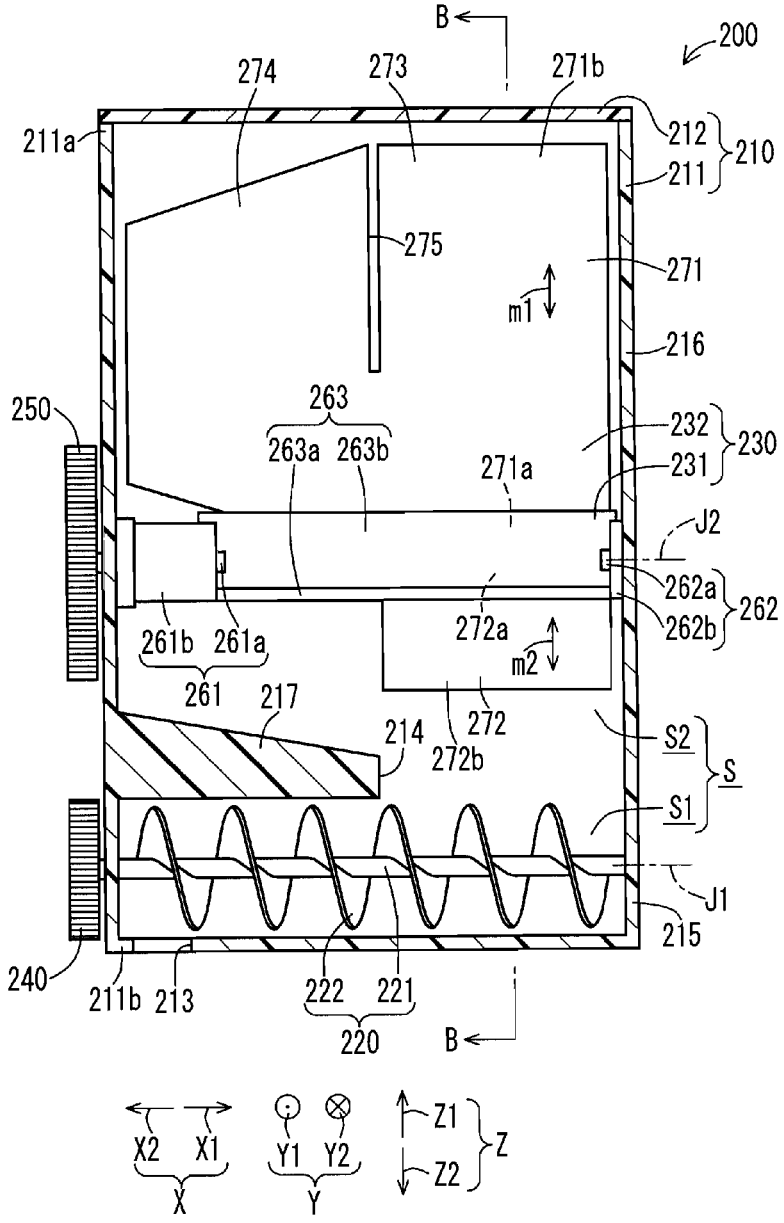
FIG. 4 is a sectional view of the toner cartridge taken along the line A-A in FIG. 3.
Figure 5:
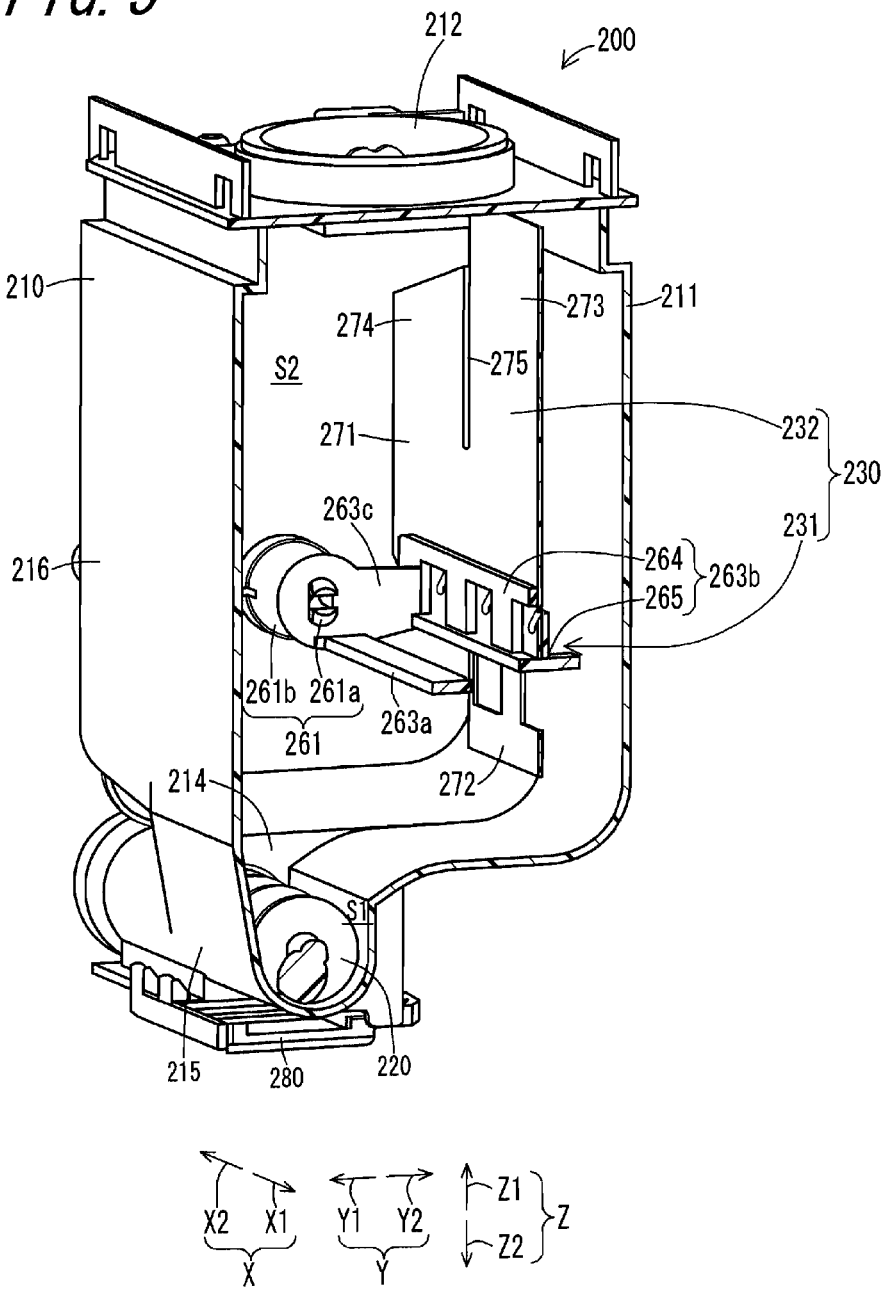
FIG. 5 is a perspective view of the toner cartridge when cut along the line B-B in FIG. 4.
Figure 6:
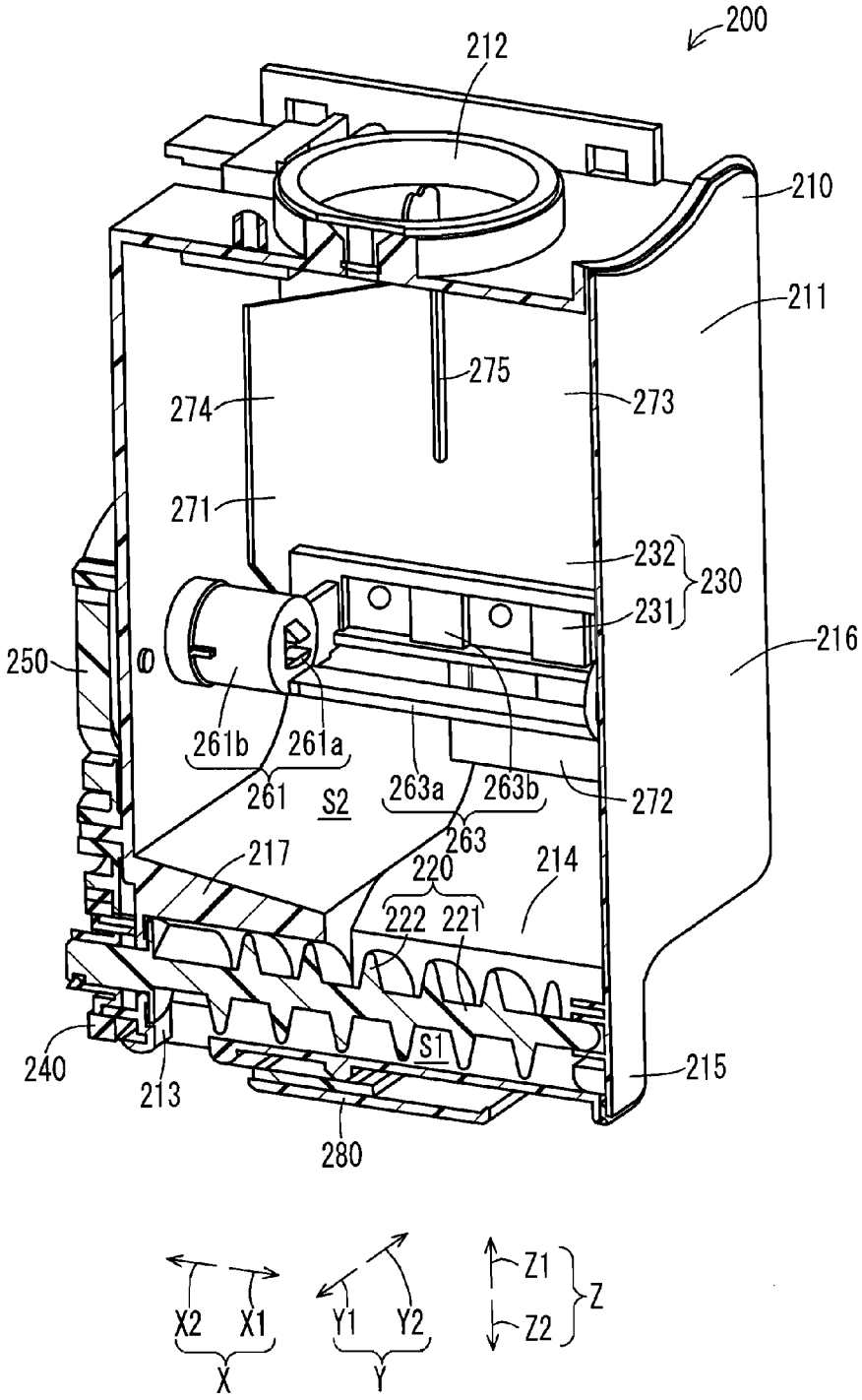
FIG. 6 is a perspective view of the toner cartridge when cut along the line A-A in FIG. 3.

Next, the toner cartridge 200 will be described. FIGS. 3 to 6 are diagrams illustrating the configuration of the toner cartridge 200 according to an embodiment. FIG. 3 is a sectional view of the toner cartridge 200 taken along the line B-B in FIG. 4, and FIG. 4 is a sectional view of the toner cartridge 200 taken along the line A-A in FIG. 3. FIG. 5 is a perspective view of the toner cartridge 200 when cut along the line B-B in FIG. 4, and FIG. 6 is a perspective view of the toner cartridge 200 when cut along the line A-A in FIG. 3.

In FIGS. 3 to 6, an up-down direction of the toner cartridge 200 is represented by arrow Z, a depth direction perpendicular to the up-down direction is represented by arrow X, and a width direction perpendicular to the up-down direction and the depth direction is represented by arrow Y. Here, the up-down direction of the toner cartridge 200 is a direction corresponding to the up-down direction of the image forming apparatus 100 when the toner cartridge 200 is mounted in the image forming apparatus 100, that is, the vertical direction, and of the up-down direction Z, the upper side is represented by arrow Z1, and the lower side is represented by arrow Z2. In the depth direction X and the width direction Y, one side is represented by arrows X1 and Y1, and the other side is represented by arrows X2 and Y2.

The toner cartridge 200 mostly includes a toner storage container 210, the toner discharge member 220, a toner stirring member 230, a first rotating gear 240, a second rotating gear 250, and a toner discharge port opening/closing mechanism 280.

The toner storage container 210 is a container-shaped member having a space S in which a toner to be replenished into the developing device 24 is stored, and has a container 211 and an upper lid 212. The container 211 is a bottomed container-shaped member which has an opening portion 211*a* formed in the upper end portion and which is opened toward the upper side Z1. The upper lid 212 is a plate-shaped member which closes an opening defined by the opening portion 211*a*.

The lower end portion of the container 211 has an opening 211*b* which substantially has the same shape and size as an upper opening portion of the toner supply pipe 300 provided in the image forming apparatus 100, and the opening 211*b* constitutes a toner discharge port 213 which communicates with the space S and an external space on the lower side Z2 of the toner storage container 210 in the up-down direction Z.

The toner discharge port 213 is formed in the lower end portion of the container 211 at a position capable of communicating with an opening of the upper opening portion of the toner supply pipe 300 when the toner cartridge 200 is mounted in the image forming apparatus 100. In this embodiment, as described below, in a toner discharge section 215, the toner discharge port 213 is formed on the other side X2 in the depth direction. The toner is replenished from the toner cartridge 200 into the developing tank through the toner discharge port 213 with consumption of toner in the developing tank in the developing device 24.

The space S which is formed in the toner storage container 210 has a first toner storage space S1 which is a space formed in the lower part of the container 211 and extends to the toner discharge port 213, and a second toner storage space S2 which is a space formed on the upper size Z1 of the first toner storage space S1 and extends to an opening defined by the opening portion 211*a*. The first toner storage space S1 and the second toner storage space S2 communicate with each other in the up-down direction Z through a communicating hole 214.

The toner storage container 210 has the toner discharge section 215 which defines the first toner storage space S1, a toner storage section 216 which defines the second toner storage space S2, and a partition wall 217 (communicating hole forming section) which partitions the first toner storage space S1 and the second toner storage space S2. The partition wall 217 forms the communicating hole 214 which communicates with the first toner storage space S1 and the second toner storage space S2.

The first toner storage space S1 is a space extending in the depth direction X and having a substantially columnar shape. In this embodiment, in the toner discharge section 215, the first toner space S1 communicates with the communicating hole 214 near a wall on one side X1 in the depth direction and communicates with the toner discharge port 213 near a wall on the other side X2 in the depth direction.

The second toner storage space S2 is a space having enough volume to store unused toner to be replenished into the developing device 24 and formed in a substantially rectangular parallelepiped shape. The dimension in the depth direction X of the second toner storage space S2 is substantially equal to the dimension in the depth direction X of the first toner storage space S1, and the dimension in the width direction Y of the second toner storage space S2 is greater than the dimension in the width direction Y of the first toner storage space S1.

In this embodiment, the second toner storage space S2 communicates with the communicating hole 214 near an internal corner portion formed by the wall on one side X1 in the depth direction and one side Y1 in the width direction in the toner storage section 216.

In the first toner storage space S1, the toner discharge member 220 is provided. The toner discharge member 220 is an auger screw-shaped member including a conveying shaft 221 and a conveying blade 222, and is rotatably supported by the wall on one side X1 and the wall on the other side X2 in the depth direction in the toner discharge section 215 such that an axial line J1 of the conveying shaft 221 extends in parallel with the depth direction X.

The conveying shaft 221 is, for example, a columnar member having an outer diameter of 3 mm to 10 mm. In the conveying shaft 221, one end portion in an axial direction thereof is provided to pass through the wall on the other side X2 in the depth direction in the toner discharge section 215 and to protrude outward from the wall, and the first rotating gear 240 is connected to one end portion. The conveying shaft 221 is formed of, for example, a material, such as polyethylene, polypropylene, high impact polystyrene, or ABS resin (acrylonitrile-butadiene-styrene copolymer synthetic resin).

The conveying blade 222 is a spiral member which is provided to be wound around the conveying shaft 221. The outer diameter of the conveying blade 222 is, for example, 12 mm to 25 mm. The conveying blade 222 is formed of, for example, a material such as polyethylene, polypropylene, high impact polystyrene, or ABS resin, and is preferably formed integrally with the conveying shaft 221. The spiral interval, the outer diameter, and the like of the conveying blade 222 are appropriately designed taking into consideration the rotating speed around the axial line J1 of the conveying shaft 221 and the like such that the conveying speed of toner in the first toner storage space 51 becomes a desired speed.

The first rotating gear 240 is a driving force transmission member which is fixed to one end portion of the conveying shaft 221 of the toner discharge member 220. The first rotating gear 240 is provided to be engaged with a gear connected to a driving source (motor) in the image forming apparatus 100 when the toner cartridge 200 is mounted in the image forming apparatus 100. When a driving force outputted from the driving source is inputted, the first rotating gear 240 rotates the toner discharge member 220 in a rotational direction R1 around the axial line J1. The driving source is electrically connected to a control section of the image forming apparatus 100, and the rotation operation of the toner discharge member 220 is controlled by the control section.

The toner discharge member 220 receives the driving force transmitted through the first rotating gear 240 and rotates in the rotational direction R1 around the axial line J1 so as to convey a toner stored in the first toner storage space S1 in the toner discharge section 215 from one side X1 in the depth direction toward the other side X2, in other words, from the side in the depth direction X on which the communicating hole 214 is formed toward the side on which the toner discharge port 213 is formed. The toner conveyed toward the other side X2 in the depth direction by the rotation operation of the toner discharge member 220 is conveyed to the upper side Z1 of the toner discharge port 213, then falls to the lower side Z2 through the toner discharge port 213, is discharged from the toner cartridge 200, and is supplied into the developing tank of the developing device 24 through the toner supply pipe 300.

In the second toner storage space S2, the toner stirring member 230 is provided. The toner stirring member 230 includes a rotating shaft member 231 which extends between the wall on one side X1 and the wall on the other side X2 in the depth direction in the toner storage section 216, and a sheet-like stirring blade 232 which is held by the rotating shaft member 231. The rotating shaft member 231 is rotatably supported by the wall on one side X1 and the wall on the other side X2 in the depth direction in the toner storage section 216 such that an axial line J2 extends in parallel with the depth direction X.

The rotating shaft member 231 generally has a first shaft portion 261 which is a portion provided adjacent to the wall on the other side X2 in the depth direction in the toner storage section 216, a second shaft portion 262 which is a portion provided adjacent to the wall on one side X1 in the depth direction, and an intermediate portion 263 which extends between the first shaft portion 261 and the second shaft portion 262. The rotating shaft member 231 is formed of, for example, a material such as polyethylene, polypropylene, high impact polystyrene, or ABS resin, so as to rotate integrally around the axial line J2.

The first shaft portion 261 has a columnar first rod-shaped body 261*a* which extends along the axial line J2, passes through the wall on the other side X2 in the depth direction in the toner storage section 216, and is rotatably supported by the wall, and a substantially columnar first base portion 261*b* which is fixed to a portion protruding inward from the wall on the other side X2 in the depth direction in the first rod-shaped body 261*a* coaxially with the axial line J2.

The first shaft portion 261 is configured such that the amount of protrusion of the first base portion 261*b* from the wall on the other side X2 in the depth direction toward one side X1 in the depth direction is sufficiently smaller than the dimension in the depth direction X of the second toner storage space S2. The second rotating gear 250 is connected to a portion protruding outward from the wall on the other side X2 in the depth direction in the first rod-shaped body 261*a*.

The second shaft portion 262 has a columnar second rod-shaped body 262*a* which extends along the axial line J2 and is rotatably supported by the wall on one side X1 in the depth direction in the toner storage section 216, and a substantially columnar second base portion 262*b* which is fixed to a portion protruding inward from the wall on one side X1 in the depth direction in the second rod-shaped body 262*a* coaxially with the axial line J2, and substantially has the same outer diameter as the first base portion 261*b*.

Similarly to the first shaft portion 261, the second shaft portion 262 is configured such that the amount of protrusion of the second base portion 262*b* from the wall on one side X1 in the depth direction toward the other side X2 in the depth direction is sufficiently smaller than the dimension in the depth direction X of the second toner storage space S2. That is, a gap which has a dimension slightly smaller than the dimension in the depth direction X of the second toner storage space S2 is formed between the end surface of the first base portion 261*b* and the end surface of the second base portion 262*b*.

The intermediate portion 263 includes a rod-shaped stirring piece 263*a* which extends in parallel with the axial line J2 at a gap with respect to the axial line J2 in a radial direction perpendicular to the axial line J2, and is connected to an end surface of the first base portion 261*b* and an end surface of the second base portion 262*b*, a rod-shaped stirring blade holding piece 263*b* which extends in parallel with the axial line J2 outward in the radial direction perpendicular to the axial line J2 from an outer circumferential surface of the first base portion 261*b* and the second base portion 262*b*, and is formed so as to be slightly longer than a distance between the end surface of the first shaft portion 261 and the end surface of the second shaft portion 262, and a pair of connecting portions 263*c* which extends in the radial direction perpendicular to the axial line J2 and connect the respective end portions of the stirring blade holding piece 263*b* in a longitudinal direction thereof with the first base portion 261*b* and the second base portion 262*b*.

The stirring blade holding piece 263*b* has a body portion 264 connected to the pair of connecting portions 263*c*, and a cap portion 265 which is detachably attached to the body portion 264 outward in the radial direction perpendicular to the axial line J2. The cap portion 265 is attached to the body portion 264 in a state where the stirring blade 232 is inserted between the body portion 264 and the cap portion 265, whereby the stirring blade holding piece 263*b* holds the stirring blade 232.

Here, when a direction from the axial line J2 toward the stirring blade holding piece 263*b* in the radial direction perpendicular to the axial line J2 is referred to as a holding piece direction k, the stirring blade holding piece 263*b* holds the stirring blade 232 while a thickness direction of the stirring blade 232 corresponds to the holding piece direction k.

As shown in FIG. 3, in the rotating shaft member 231 configured as above, the axial line J2 is provided at a position on the lower side Z2 slightly from the substantial center in the up-down direction Z at the substantial center in the width direction Y in the toner storage section 216. The stirring blade holding piece 263*b* is distant from the axial line J2 in the holding piece direction k such that the rotating shaft member 231 does not come into contact with the inner surface of the toner storage section 216 when rotating around the axial line J2.

The stirring blade 232 is a flexible sheet-like member, and as described above, is fixed to the stirring blade holding piece 263*b* such that the thickness direction corresponds to the holding piece direction k. A constituent material of the stirring blade 232 is not particularly limited insofar as the constituent material is flexible, and for example, resin such as polyethylene telephthalate (PET) resin, is preferably used. The thickness of the stirring blade 232 is, for example, 0.1 mm to 0.5 mm. The details of the stirring blade 232 will be described below.

The second rotating gear 250 is a driving force transmission member which is fixed to the end portion of the first rod-shaped body 261*a* in the rotating shaft member 231 of the toner stirring member 230. The second rotating gear 250 is provided so as to be engaged with a gear connected to a driving source (motor) in the image forming apparatus 100 when the toner cartridge 200 is mounted in the image forming apparatus 100. When a driving force outputted from the driving source is inputted, the second rotating gear 250 rotates the toner stirring member 230 in a rotational direction R2 around the axial line J2. The driving source is connected to the control section of the image forming apparatus 100, and the rotation operation of the toner stirring member 230 is controlled by the control section. The rotational direction R2 is a clockwise direction when viewed from one side X1 in the depth direction.

Hereinafter, the details of the stirring blade 232 will be described.

As shown in FIG. 3, the stirring blade 232 has a first blade portion 271 which extends from the stirring blade holding piece 263*b* toward an upstream side in the rotational direction R2 in a state of being fixed to the stirring blade holding piece 263*b*, and a second blade portion 272 which extends from the stirring blade holding piece 263*b* toward a downstream side in the rotational direction R2.

The first blade portion 271 is formed in a substantially rectangular shape when viewed from a thickness direction thereof, a first base end portion 271*a* which is one edge portion is fixed to the stirring blade holding piece 263*b* along the depth direction X, and in regard to a first direction m1 perpendicular to both the thickness direction and the extension direction of the first base end portion 271*a*, a first free end portion 271*b* which is an edge portion extending to an opposite side to the first base end portion 271*a* is located on the upstream side in the rotational direction R2 from the first base end portion 271*a*.

In this embodiment, as described above, since the stirring blade 232 is fixed to the stirring blade holding piece 263*b* in a state where the thickness direction corresponds to the holding piece direction k, the first direction m1 is at a substantially right angle with respect to a line which connects the first base end portion 271*a* and the axial line J2.

In addition, the dimension of the first blade portion 271 in the extension direction of the first base end portion 271*a* is determined such that, when the first base end portion 271*a* is fixed to the stirring blade holding piece 263*b*, each edge portion in the extension direction of the first base end portion 271*a* is provided at a slight clearance with respect to each of the wall on one side X1 and the wall on the other side X2 in the depth direction of the toner storage section 216.

Further, the dimension of the first blade portion 271 in the first direction m1 is determined such that, when the toner stirring member 230 is rotated in the rotational direction R2 around the axial line J2, the first free end portion 271*b* rotates while sequentially coming into contact with the respective inner surfaces of the wall on the other side Y2 in the width direction, the wall on the lower side Z2, and the wall on one side Y1 in the width direction in the toner storage section 216.

In other words, the dimension of the first blade portion 271 in the first direction m1 is determined such that, when the first base end portion 271*a* is fixed to the stirring blade holding piece 263*b*, a distance between the axial line J2 and the first free end portion 271*b* is greater than a distance between the axial line J2 and the wall on the other side Y2 in the width direction in the toner storage section 216, a distance between the axial line J2 and the wall on the lower side Z2 in the toner storage section 216, and a distance between the axial line J2 and the wall on one side Y1 in the width direction in the toner storage section 216, respectively.

In this embodiment, as shown in FIG. 4, in the first blade portion 271, a portion from a central portion in the first direction m1 to the first free end portion 271*b* is divided into a communicating hole-side blade portion 273, which is provided in the depth direction X corresponding to a region where the communicating hole 214 is formed, and a partition wall-side blade portion 274, which is provided corresponding to a region where the partition wall 217 is provided, by a linear notch 275 which extends in parallel with the first direction m1 from the first free end portion 271*b* toward the first base end portion 271*a*.

The second blade portion 272 is formed in a substantially rectangular shape when viewed from a thickness direction thereof, a second base end portion 272*a* which is one edge portion is fixed to the stirring blade holding piece 263*b* along the depth direction X, and in regard to a second direction m2 perpendicular to both the thickness direction and the extension direction of the second base end portion 272*a*, a second free end portion 272*b* which is an edge portion extending to an opposite side to the second base end portion 272*a* is located on the downstream side in the rotational direction R2 from the second base end portion 272*a*.

In this embodiment, as described above, since the stirring blade 232 is fixed to the stirring blade holding piece 263*b* in a state where the thickness direction corresponds to the holding piece direction k, the second direction m2 is at a substantially right angle with respect to a line which connects the second base end portion 272*a* and the axial line J2.

In addition, the second blade portion 272 is configured such that the dimension in the extension direction of the second base end portion 272*a* is substantially equal to the dimension in the depth direction X of the communicating hole-side blade portion 273 in the first blade portion 271, and similarly to the communicating hole-side blade portion 273, is provided corresponding to the region where the communicating hole 214 is formed.

Further, the dimension of the second blade portion 272 in the second direction m2 is determined such that, when the toner stirring member 230 is rotated around the axial line J2, the second free end portion 272*b* rotates without coming into contact with the inner surface of each wall in the toner storage section 216.

In other words, as shown in FIG. 3, the dimension of the second blade portion 272 in the second direction m2 is determined such that, when the toner stirring member 230 is rotated around the axial line J2, the second free end portion 272*b* draws a circular locus p inside the inner surface of each wall in the toner storage section 216.

The toner stirring member 230 having the stirring blade 232 configured as above receives the driving force transmitted through the second rotating gear 250 and rotates in the rotational direction R2 around the axial line J2, whereby the toner stored in the second toner storage space S2 in the toner storage section 216 is stirred and crumbed by the stirring piece 263*a* and the stirring blade 232.

According to this embodiment, the toner stirring member 230 is provided with the first blade portion 271, which rotates while coming into contact with the inner surface of each wall in the toner storage section 216, and the second blade portion 272, which rotates without coming into contact with the inner surface of each wall in the toner storage section 216, in accordance with the rotation operation.

Accordingly, in the case where the residual amount of toner stored in the toner storage section 216 is small, the first free end portion 271*b* slides on the inner surface of each wall in the toner storage section 216 while the first blade portion 271 is deformed, whereby the toner stuck to the inner surface of the toner storage section 216 can be scraped off.

In addition, in a state where the amount of toner stored in the toner storage section 216 is large, the second blade portion 272 rotates such that the second free end portion 272*b* draws the circular locus p shown in FIG. 3, whereby it is possible to crumb the toner on the upper side of the communicating hole 214 and to prevent the consolidation state of toner stored in the toner discharge section 215. Accordingly, even if the amount of toner stored in the toner storage section 216 is large, it is possible to prevent the occurrence of toner discharge failure.

In addition, according to this embodiment, since the second blade portion 272 is configured to have flexibility, even if the toner is loosely aggregated and its fluidity is lowered, it is possible to prevent excessive stress from being applied to the toner.

Further, according to this embodiment, since the second blade portion 272 is fixed to the rotating shaft member 231 such that the second free end portion 272*b* is located on the downstream side in the rotational direction R2 from the second base end portion 272*a*, even if the second blade portion 272 has flexibility, the second blade portion 272 can be hard to be curved to the upstream side in the rotational direction R2, and it is possible to prevent degradation of a stirring force by the second blade portion 272.

Furthermore, according to this embodiment, since the first blade portion 271 is fixed to the rotating shaft member 231 such that the first free end portion 271*b* is located on the upstream side in the rotational direction R2 from the first base end portion 271*a*, it is possible to allow the first blade portion 271 to be easily curved to the upstream side in the rotational direction R2. Accordingly, in the case where the residual amount of toner stored in the toner storage section 216 is small, it is possible to reduce a frictional force when the first free end portion 271*b* slides on the inner surface of each wall in the toner storage section 216.

In this embodiment, although the first blade portion 271 and the second blade portion 272 are realized as a part of the stirring blade 232 composed of a single sheet member, in other embodiments, the first blade portion 271 and the second blade portion 272 may be realized by separate sheet members.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A toner cartridge mountable in an electrophotographic image forming apparatus with a developing device, comprising:

a toner storage container having a toner storage section which stores a toner therein, a toner discharge section provided vertically below the toner storage section in a mounted state in the image forming apparatus, the toner discharge section having a toner discharge port for discharging a toner, and a communicating hole forming section which forms a communicating hole for guiding the toner in the toner storage section to the toner discharge section;

a toner stirring member which is rotatably supported by the toner storage section and stirs the toner stored in the toner storage section, and a toner discharge member which is rotatably supported by the toner discharge section and conveys the toner guided from the toner storage section to the toner discharge section through the communicating hole toward the toner discharge port, the toner stirring member including a rotating shaft member which is supported by the toner storage section so as to be rotatable around an axial line thereof, a flexible sheet-like first stirring blade of which one end portion in a predetermined first direction perpendicular to a thickness direction thereof is fixed to the rotating shaft member along the axial line, the flexible sheet-like first stirring blade having a length so that the other end portion in the predetermined first direction comes into contact with an inner surface of the toner storage section in the predetermined first direction, and a flexible sheet-like second stirring blade of which one end portion in a predetermined second direction perpendicular to a thickness direction thereof is fixed to the rotating shaft member along the axial line, the flexible sheet-like second stirring blade having a length so that the other end portion in the predetermined second direction does not come into contact with the inner surface of the toner storage section in the predetermined second direction.

2. The toner cartridge of claim 1, further comprising a driving force transmission member connected to the rotating shaft member, the driving force transmission member transmitting a driving force for rotating the rotating shaft member in a rotational direction which is one circumferential direction around the axial line, to the rotating shaft member, wherein the flexible sheet-like second stirring blade is configured so that the one end portion is distant from the axial line in a radial direction perpendicular to the axial line, and the other end portion is located on a downstream side in the rotational direction from the one end portion.

3. The toner cartridge of claim 2, wherein the flexible sheet-like first stirring blade is configured so that the one end portion is distant from the axial line in the radial direction perpendicular to the axial line, and the other end portion is located on an upstream side in the rotational direction from the one end portion.

4. The toner cartridge of claim 1, wherein a distance between the axial line and the other end portion of the flexible sheet-like first stirring blade is larger than a distance between the axial line and the inner surface of the toner storage section.

5. The toner cartridge of claim 4, wherein a distance between the axial line and the other end portion of the flexible sheet-like second stirring blade is smaller than the distance between the axial line and the inner surface of the toner storage section.

6. The toner cartridge of claim 1, wherein the flexible sheet-like first stirring blade and the flexible sheet-like second stirring blade are composed of a single sheet member.

7. The toner cartridge of claim 1, wherein the flexible sheet-like first stirring blade and the flexible sheet-like second stirring blade are composed of separate sheet members.

8. An electrophotographic image forming apparatus with a developing device, comprising:

the toner cartridge of claim 1 which supplies a toner to the developing device.

* * * * *